United States Patent [19]

Norton

[11] Patent Number: 4,501,126

[45] Date of Patent: Feb. 26, 1985

[54] METHOD AND APPARATUS FOR LIQUID FREEZING

[75] Inventor: John P. Norton, Creve Coere, Mo.

[73] Assignee: Engineered Air Systems, Inc., St. Louis, Mo.

[21] Appl. No.: 569,177

[22] Filed: Jan. 9, 1984

Related U.S. Application Data

[62] Division of Ser. No. 474,164, Mar. 10, 1983, Pat. No. 4,459,812.

[51] Int. Cl.[3] ..... F25D 17/02

[52] U.S. Cl. ..... 62/185; 417/313

[58] Field of Search ..... 62/436, 185, 201, 524; 417/360, 313; 137/565

[56] References Cited

U.S. PATENT DOCUMENTS

| | | | |
|---|---|---|---|
| 1,747,958 | 2/1930 | Thompson | 62/524 |
| 1,896,953 | 2/1933 | Hassell | 62/185 |
| 4,422,305 | 12/1983 | Grosskopf | 62/430 |

*Primary Examiner*—William E. Wayner
*Assistant Examiner*—J. Sollecito
*Attorney, Agent, or Firm*—Ralph B. Brick

[57] ABSTRACT

A method and apparatus for rapidly chilling a cool pack associated with a refrigeration system wherein slush-like medium is introduced into the pack in a first step and frozen to a substantially solid state in a second step.

3 Claims, 3 Drawing Figures

METHOD AND APPARATUS FOR LIQUID FREEZING

This application is a division of application Ser. No. 06/474,164, filed Mar. 10, 1983, now U.S. Pat. No. 4,459,812.

BACKGROUND OF THE INVENTION

The present invention relates to a method and apparatus for freezing a liquid medium and more particularly to a method and apparatus for freezing a preselected liquid medium to be introduced into a heat transfer chamber in the form of a cool pack utilized in cool suit clothing such as that worn by personnel to confront oppressive heat conditions.

Cool suits worn by military ground crews, armorers and the like include cool packs which comprise unit heat transfer chambers containing a liquid medium that has been frozen in the unit chambers at a central refrigeration station. In the past these unit chambers have been bulky to extend the cooling capacity when the packs have been inserted in a cool suit, utilized in the heated area and returned for recharging, with extensive amounts of time being required. Further complications have arisen by the need to have several spare cool packs so that in the freezing process at the central refrigeration area some packs can already be frozen and some can be in the process of freezing—while still others can be in use.

The present invention, recognizing these problems of the past, provides a straight forward method and apparatus for preparing cool packs for field use which require a minimum of steps, time and parts and which prove economical in both operation and maintenance. Because of the rapid manner in which the cool packs can be prepared for field use by the present invention, the number of cool packs carried can be reduced, as can the overall energy requirements.

It is to be understood that the method and apparatus of the present invention should not be considered as limited to use only for military purposes but also can be utilized in any other environment including commercial situations where it is desirable to quickly and efficiently provide frozen heat transfer medium such as in ice making for beverage cooling.

Various other features of the present invention will become obvious upon reading the inventive method and apparatus set forth hereinafter.

SUMMARY OF THE INVENTION

More particularly the present invention provides a method for quickly freezing a liquid medium by cooling the medium in a first cooling zone to a slush-like state and then introducing the slush-like medium into a second cooling zone and cooling it to a frozen state. In addition, the present invention provides a novel refrigeration assembly and cool pack assembly utilized therewith including first and second liquid chillers, each having evaporators associated therewith, one having a temperature control to bring a liquid medium therein to a slush-like state and the other having a temperature control to bring a second liquid medium therein to a temperature below the slush-like medium with the cool pack assembly including a heat transfer unit therein to allow the second medium to quickly freeze the slush-like medium when both mediums have been pumped into heat transfer relationship in the pack.

It is to be understood that various changes can be made by one skilled in the art in the arrangement, form, construction and several steps setforth hereinafter without departing from the scope or spirit of the present invention.

DESCRIPTION OF THE DRAWINGS

Referring to the drawings which disclose one advantageous embodiment of the present invention.

DESCRIPTION OF THE PREFERRED EMBODIMENT

Figure 3:
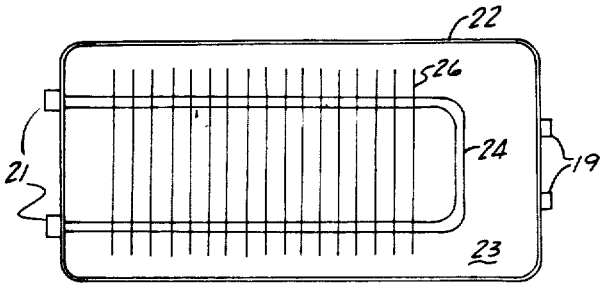
FIG. 3. is a side view of the cool pack unit of FIG. 2 taken in plane passing through line 3—3 of FIG. 2.
Figure 2:
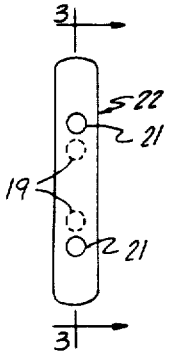
FIG. 2. is a schematic end view of the novel cool pack assembly unit.
Figure 1:
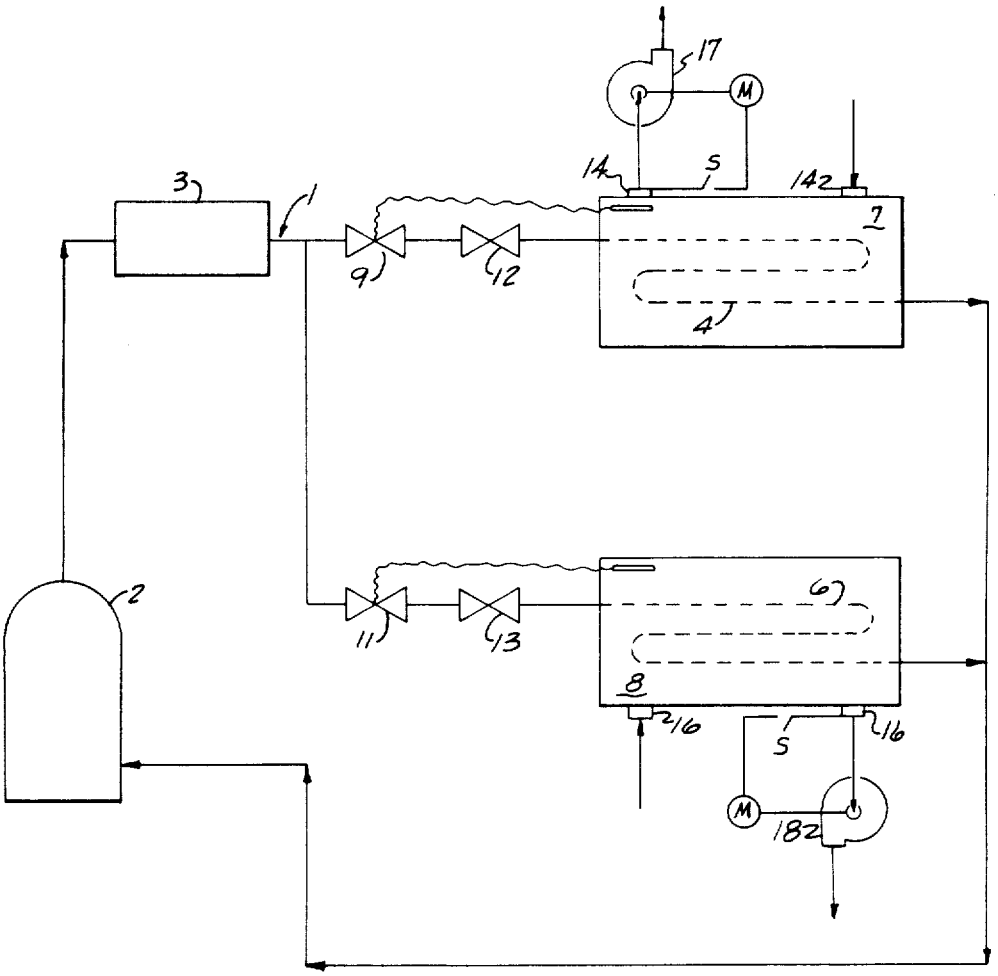
FIG. 1. is a schematic view of the refrigeration system of the present invention.

As can be seen in FIG. 1 of the drawings, the refrigeration system 1 includes a compressor 2, a condenser 3 and parallel disposed evaporators 4 and 6 which respectively form part of "brine-type" chiller chambers 7 and 8 respectively. The chillers and evaporators, which are shown schematically, can be any one of several well known commercial types manufactured by companies such as Carrier Air Conditioning Co., Dunham-Bush Inc,. Trans Co., Borg Warner Corp. and Westinghouse Electric Corp.

Each evaporator 4 and 6 is respectively arranged to include a temperature regulator control 9 and 11 which can be any one of several types known in the art and sold by such manufacturers as Honeywell, Inc., Robertshaw Controls Co., Johnson Service Co. and Penn Controls, Inc. As is conventional in a refrigeration system, each evaporator 4 and 6 also is proceded respectively by a thermal expansion valve 12 and 13.

Each chiller 7 and 8 is provided with fluid inlet and outlet conduit sets 14 and 16 respectively. Suitable liquid pumps 17 and 18 are provided with each of the conduit sets 14 and 16. These liquid pumps are also shown schematically and can be selected from anyone of several pump manufacturers such as Bell & Gossett, ITT, Sarco or Peerless Pump Div., FMC Corp. Eacb pump can be arranged to be actuated by suitable switching mechanisms S and motors M when the fluid inlet and outlet sets 14 and 16 of the chillers are connected with the fluid outlet and inlet sets 19 and 21 of the novel cool pack 22 described hereinafter. It is to be understood that the temperature regulator controls 9 and 11 are set to control suitable liquid mixtures such as preselected quantities of ethylene glycol and water disposed in each chiller 7 and 8 so that the evaporator 4 in chiller 7 causes the mixture to form into a slush-like state, advantageously at approximately 0° F. and the evaporator 6 in chiller 8 causes the mixture therein to be held at a temperature below the temperature of the mixture held in a slush-like state in chiller 7. Advantageously, the freeze point of the mixture in chiller 8 can be preselected to be at minus (−) 32° F.

The unit cool pack 22 which can be arranged to be made in compact form from any one of a number of suitable heat transfer materials formed from polystyrene or polyethylene in any one of a number of suitable shapes includes the aforedescribed fluid inlet and outlet conduit sets 19 and 21 which are respectively sized and shaped to engage with sets 14 and 16 of chillers 7 and 8. It is to be understood that the conduit sets 14 and 16 and 19 and 21 aforedescribed can be provided with any one of several quick connect and disconnect arrangements (not shown) which are available on the commercial market from coupling manufacturers such as Aeroquip Corp., Nibco, Inc. and Midland-Ross Corp.

It is to be noted that fluid inlet and outlet set 19 of cool pack 22 is connected to the main chamber 23 of pack 22 and fluid inlet and outlet set 21 is connected to a heat exchange tubular element 24 disposed within chamber 23. Element 24 is schematically disclosed as including heat exchange fins 26 but it is to be understood that these fins can be eliminated and that various tubular conformations can be utilized.

In a typical operation of the method and apparatus of the arrangement disclosed a cool pack is brought to refrigeration system 1 which can be centrally located. Fluid inlet and outlet set 19 communicating with chamber 23 is quickly connected to fluid inlet and outlet set 14 of chiller 7 with pump 17 being actuated through a switch S and a motor M to cause a slush-like state fluid medium to be introduced into chamber 23 of cool pack 29. Once cool pack chamber 23 is filled, the cool pack 22 is disconnected from chiller 7, turned around and connected through fluid inlet and outlet sets 16 and 21 to chiller chamber 8. This actuates pump 18 for chiller chamber 8 through a switch S and a motor M and liquid medium at a temperature below the freeze point of the slush-like medium now in chamber 23 is circulated through heat exchange conduit 24 to cause the slush-like medium to quickly freeze. Cool pack 22 can then be disconnected for use in a cool suit or other heat zone environment. Thus, in a straightforward, economical manner the fluid, medium in chamber 23 can be brought to freeze state quickly over and over again with the fluid mediums being reutilized as they are circulated in their chiller chambers 7 and 8 by the respective pumps 17 and 18.

The invention claimed is:

1. Apparatus for rapidly freezing a cool pack chamber comprising: a refrigeration system including a compressor, a condenser, first and second evaporators in said system, first and second liquid chiller chambers respectively enclosing said first and second evaporators, each chiller chamber having fluid inlet and outlet conduit sets provided with quick disconnect fittings and a pump to circulate a liquid cooling medium therethrough, said refrigeration system further including temperature regulating means for said evaporators whereby a first liquid cooling medium in said first chiller chamber can be maintained at a temperature slightly above the freeze point to bring said first medium to a slush-like state and a second liquid cooling medium in said second chiller chamber can be maintained at a temperature below the freeze point of said first liquid cooling medium and an independent cool pack comprising a separately portable heat transfer envelope defining an uninterrupted flow through cool pack chamber including a first set of fluid inlet and outlet conduits disposed in said heat transfer envelope and provided with quick disconnect coupler fittings sized and positioned to connect respectively with the fluid outlet and fluid inlet set of said first liquid chiller chamber to allow introduction of said slush-like medium into said cool pack chamber, a heat exchange element disposed in said cool-pack chamber extending in uninterrupted fashion substantially throughout said chamber, said heat exchange element including a second fluid inlet and outlet conduit set disposed in said heat transfer envelope and provided with quick disconnect coupler fittings sized and positioned to connect respectively with the fluid outlet and fluid inlet set of said second liquid chiller chamber to allow introduction of said liquid cooling medium from said second chiller chamber which is below the freeze point of said slush-like medium introduced into said cool pack chamber from said first liquid chiller to cause said slush-like medium to freeze.

2. Apparatus for rapidly freezing a cool pack chamber comprising: a refrigeration system including a compressor, a condenser, first and second evaporators in said system, first and second liquid chiller chambers respectively enclosing said first and second evaporators, each chiller chamber having fluid inlet and outlet conduit sets provided with quick disconnect fittings and a pump to circulate a liquid cooling medium therethrough, said refrigeration system further including a temperature regulating means for said evaporators whereby a first liquid cooling medium in said first chiller chamber can be maintained at a temperature slightly above the freeze point to bring said first medium to a slush-like state and a second liquid cooling medium in said second chiller chamber can be maintained at a temperature below the freeze point of said first liquid cooling medium and a cool pack chamber including a first set of fluid inlet and outlet conduits provided with quick disconnect fittings sized and positioned to connect respectively with the fluid outlet and fluid inlet set of said first liquid chiller chamber to allow introduction of said slush-like medium into said cool pack chamber, a heat exchange element disposed in said cool pack chamber, said heat exchange element including a second fluid inlet and outlet conduit set provided with quick disconnect fittings sized and positioned to connect respectively with the fluid outlet and fluid inlet set of said second liquid chiller chamber to allow introduction of said liquid cooling medium from said second chiller chamber which is below the freeze point of said slush-like medium introduced into said cool pack chamber from said first liquid chiller to cause said slush-like medium to freeze, each of said pumps of said chillers including actuating means to actuate said pump when connected to its respective fluid inlet and outlet set of said cool pack.

3. An independent cool pack comprising a separately portable heat transfer envelope defining an uninterrupted, flow through cool pack chamber;

a first set of fluid inlet and outlet conduits disposed in said heat transfer envelope provided with quick disconnect coupler fittings sized and positioned to connect respectively with the fluid outlet and fluid inlet conduit set of a liquid chiller chamber to receive a slush-like fluid medium therefrom for circulation throughout said envelope;

and a heat exchange element disposed in said cool pack chamber extending in uninterrupted fashion substantially throughout said chamber, said heat exchange element including a second set of fluid inlet and outlet conduits disposed in said heat transfer envelope and also provided with quick disconnect coupler fittings sized and positioned to connect respectively with the fluid outlet and fluid inlet conduit set of a second chiller chamber to receive a fluid medium therefrom below the freeze point of the slush-like medium in said cool pack chamber to cause said slush-like medium to freeze.

* * * * *